United States Patent [19]

Yamamoto et al.

[11] Patent Number: 4,839,695

[45] Date of Patent: Jun. 13, 1989

[54] DEVICE FOR CONTROLLING CHARGE AREA OF PHOTORECEPTOR

[75] Inventors: Haruo Yamamoto; Shusaku Ogawa, both of Osaka, Japan

[73] Assignee: Mita Industrial Co., Ltd., Osaka, Japan

[21] Appl. No.: 934,293

[22] Filed: Nov. 21, 1986

[30] Foreign Application Priority Data

Nov. 29, 1985 [JP] Japan ..... 60-270171

[51] Int. Cl.[4] ..... G03G 15/00

[52] U.S. Cl. ..... 355/218; 355/243; 355/317

[58] Field of Search ..... 355/3 CH, 14 CH

[56] References Cited

U.S. PATENT DOCUMENTS

| | | | |
|---|---|---|---|
| 4,278,342 | 7/1981 | Andrew et al. | 355/3 CH |
| 4,382,674 | 5/1983 | Miyoshi et al. | 355/3 CH |
| 4,384,785 | 5/1983 | Katoh et al. . | |
| 4,469,431 | 9/1984 | Miyoshi et al. | 355/14 CH |
| 4,576,464 | 5/1986 | Sakata et al. | 355/3 CH |
| 4,641,951 | 2/1987 | Takagi et al. | 355/3 CH |

FOREIGN PATENT DOCUMENTS

| | | | |
|---|---|---|---|
| 3025015 | 1/1982 | Fed. Rep. of Germany . | |
| 3341774 | 5/1984 | Fed. Rep. of Germany . | |
| 184955 | 10/1983 | Japan . | |
| 243676 | 12/1985 | Japan | 355/14 CH |

*Primary Examiner*—Arthur T. Grimley
*Assistant Examiner*—Edward J. Pipala
*Attorney, Agent, or Firm*—Jordan and Hamburg

[57] ABSTRACT

A device for controlling the charge area of a photoreceptor comprising a detector for detecting the length of a sheet of copying paper, another detector for detecting the length of an image projected area of the photoreceptor, a selecting device for selecting the shorter one between the detected length of the copying paper sheet and that of the image projected area by comparing them with each other, and controls for controlling the charging time of the main charger so as to charge the photoreceptor to an area corresponding to a length selected by the selecting device, whereby the charge area of the photoreceptor is properly controlled so as to correspond to an area necessary to be transferred, even when the length of the image projected area on the photoreceptor differs from that of the copying paper sheet.

13 Claims, 5 Drawing Sheets

DEVICE FOR CONTROLLING CHARGE AREA OF PHOTORECEPTOR

BACKGROUND OF THE INVENTION AND RELATED ART STATEMENT

This invention relates to a device for controlling the charge area of a photoreceptor of an image forming apparatus, such an electrostatic copying machine and the like.

A device for controlling the charge area of a photoreceptor of an electrostatic copying machine or the like has heretofore been disclosed, for example, in an unexamined patent publication of 161342/54. Specifically, the copying machine in which the reflected light from an original is projected to the photoreceptor drum charged by a main charger to form an electrostatic latent image, which is in turn developed by developing means and transferred to a sheet of copying paper by transferring means, is provided with a device for controlling the main charger so that the charge area of the photoreceptor drum corresponds to the size of a sheet of copying paper and waste of toner or pollution of various machine parts is prevented from occurring. In the other words, in such copying machine, toner is attracted to the residual charge on the photoreceptor drum after projecting the image to the drum and the toner image is transferred to the copying paper. However, when the entire surface of the photoreceptor drum is charged by the main charger, the residual charge exists outside an area of the drum corresponding to the copying paper as well after projecting the image to the drum. Then the toner is attracted to an unnecessary area, consequently resulting in the waste of toner and involving dispersion of toner which brings about pollution of parts. The aforementioned device is provided to prevent the undesirable incidents. The device enables proper control of charge area when the image projected area on the photoreceptor drum is in agreement with the size of a sheet of copying paper.

In a copying machine capable of variable magnification and reduction, when copying an original in a reduced size, it frequently occurs that the image projected area on the photoreceptor becomes smaller than the copying paper sheet. However, the conventional device is not able to prevent the incident that residual charge exists in an area which is outside the image projected area on the drum but within the area corresponding to the size of copying paper sheet and the toner is attracted to the unnecessary residual charge.

Consequently, when the toner image is transferred to the copying paper, the problem occurs which the toner is attracted to an unnecessary portion outside the toner image, such as a rear end portion of the copying paper, then resulting in a so-called solid portion. Moreover, charging an unnecessary portion outside the image projected area on the photoreceptor involves deterioration of the photoreceptor.

It is an object of the present invention to provide a device for controlling change area of a photoreceptor which has overcome the above-mentioned drawbacks.

Other objects and advantages of the present invention will become more apparent from the following description.

SUMMARY OF THE INVENTION

According to the present invention, in an image forming apparatus in which an electrostatic latent image is formed on a photoreceptor charged by a main charger by projecting a light image of an original and developed by a developing means, and transferred to copying paper, a device for controlling the charge area of the photoreceptor comprises means for detecting the length of a sheet of copying paper, means for detecting the length of the image projected area of the photoreceptor, means for selecting shorter one between the length of the copying paper sheet and that of the image projected area by comparing them to each other and means for controlling the charging time of the main charger so as to charge the photoreceptor to an area corresponding to a length selected by the selecting means.

Accordingly, the charge area of the photoreceptor can be properly controlled so as to correspond to an area necessary to transfer even when the length of the image projected area on the photoreceptor differs from that of the copying paper sheet. More specifically, since the charge time of the main charger is controlled so that the charge area corresponds to shorter one between the length of the copying paper sheet and that of image projected area of the photoreceptor, even when the length of the image projected area does not agree with that of the copying paper sheet, a waste of toner or pollution of machine parts can be prevented and a solid portion in the rear end portion of the copying paper and deterioration of a photoreceptor can be avoided.

DETAILED DESCRIPTION OF THE PREFERRED EMBODIMENTS OF THE INVENTION

Figure 1:
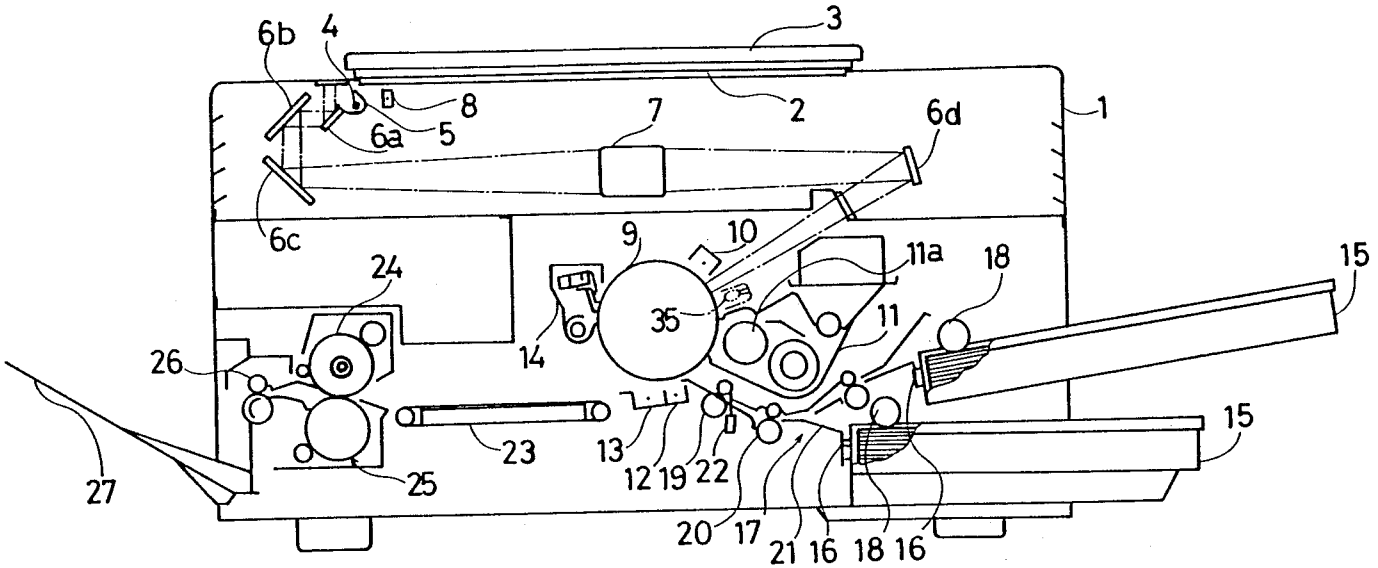
FIG. 1 is a schematic view showing a copying machine comprising an device in accordance with the present invention.

FIG. 1 shows an overall construction of an electrostatic copying machine, equipped with a device of the present invention in which numeral 1 indicates a housing, numeral 2 indicates a contact glass on which an original is to be placed, and numeral 3 indicates an original cover. Under the contact glass 2 is provided an optical system comprising an exposure lamp 4, a reflector 5, mirrors 6*a*–6*d*, and a lens assembly 7. The exposure lamp 4, reflector 5 and mirror 6*a* are driven by an optical system driving means 32 to be described later and moved back and forth underneath the contact glass 2. The mirrors 6*b* and 6*c* are made to reciprocate at half speed of the lamp 4, reflector 5 and mirror 6*a*. The optical system is provided with a timing switch 8 for detecting a state that the exposure lamp 4 and others come into a position for illuminating the forward end of the original.

Indicated at 9 is a photosensitive drum around which are disposed main charger 10 including a chargeable corona discharger, developing means 11, transferring means 12, separating means 13 and cleaning means 14 in sequence in the rotating direction. A space for exposing the photosensitive drum 9 is formed between the main charger 10 and the developing means 11. The developing means 11 includes a developing roller 11*a* for supplying toner onto the photosensitive drum 9 to develop an electrostatic latent image formed by the exposure to a toner image. The transferring means 12 electrostatically transfers the toner image formed on the photosensitive drum 9 to copying paper conveyed by a paper feeding mechanism 17 to be described later. The separating means 13 separates the transferred copying paper from the photosensitive drum 9 by means of a corona discharger. A plurality of copying paper cassettes 15 are removably mounted in an side of the housing 1. Cassette size detection swithches 16 are provided on the cassette mounting portions. The paper feeding mechanism 17 is provided between the cassette mounting portions and the transferring means 12, which comprises first paper feeding clutches 18 each including a roller for drawing copying paper from the copying paper cassette 15, a second paper feeding clutch 19 including a pair of rollers for feeding copying paper into the transferring means 12, conveyer rollers 20 disposed between the first and second clutches, and guide plates 21. A paper feeding resist switch 22 is provided immediately before the second paper feeding clutch 19 to detect copying paper fed to a position immediately before the second clutch.

A discharging belt assembly 23 is disposed in the downstream side of the separating means 13 in a discharging direction of copying paper. Further are provided fixing means 25 including fixing heat rollers 24. A receiving tray 27 for receiving the copying paper via discharge roller 26 is provided in the downstream side of the fixing means 25.

Figure 2:
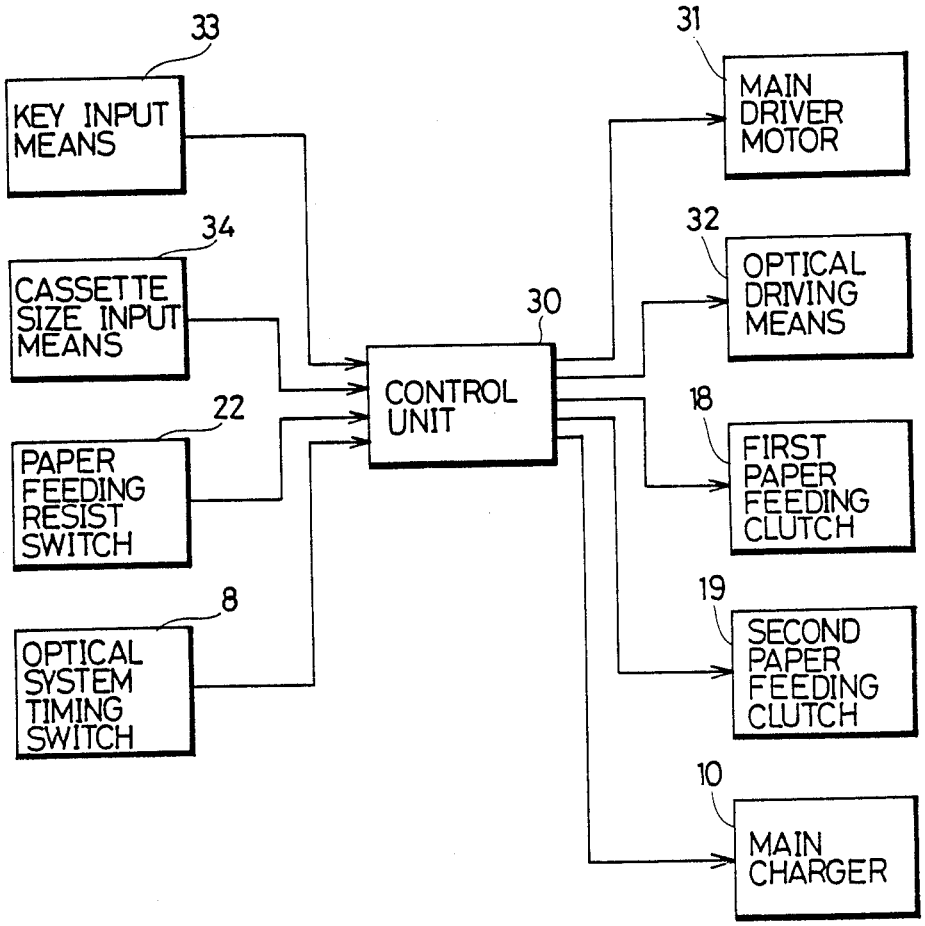
FIG. 2 is a block diagram showing a control system.

FIG. 2 is a block diagram showing a control device and a driving unit equipped in the copying machine. In the diagram, numeral 30 indicates a control unit including a microcomputer. The unit 30 controls a main driver motor 31, an optical system driving means 32, the first paper feeding clutch 18, the second paper feeding clutch 19 and the main charger device 10. The optical system driving means 32 uses another motor different from the main driver motor 31 to drive the optical system. An original image is enlarged and reduced by changing the speed of the optical system in accordance with magnification control signals from the control unit 30.

Into the control unit 30, signals from key input means 33, cassette size input means 34, the paper feeding resist switch 22 and the optical system timing switch 8 are inputted. The key input means 33 is adopted for sending a signal from a print key provided in a key board, magnification signals and copying paper size selection signals into the control unit 30. The cassette size input means 34 sends a signal concerning the length of a copying paper sheet being used into the control unit by detecting the size of the copying paper cassette 15 attached to the copying machine by the cassette size detection switch 16 and specifying the size of copying paper from a copying paper selection key, which constitutes a copying paper length detection means. Also, the control unit calculates the length of the image projected area from a signal indicating the size of original sent from the key input means 33 or an original size detection means (not shown) therein and a signal specifying the magnification, which constitutes means for detecting the length of the image projected area.

Furthermore, the control unit 30 includes selection means for comparing the length of the copying paper and that of the image projected area to select a shorter one and control means for controlling the charging time of the main charger 10 so as to charge the photosensitive drum 9 according to a length selected by the selection means, whereby control of charge area of the photosensitive drum 9 and control required for other copying operations are effected.

Control effected by the control unit 30 will be specifically explained with reference to the flow charts of FIGS. 3 and 4.

Figure 3:
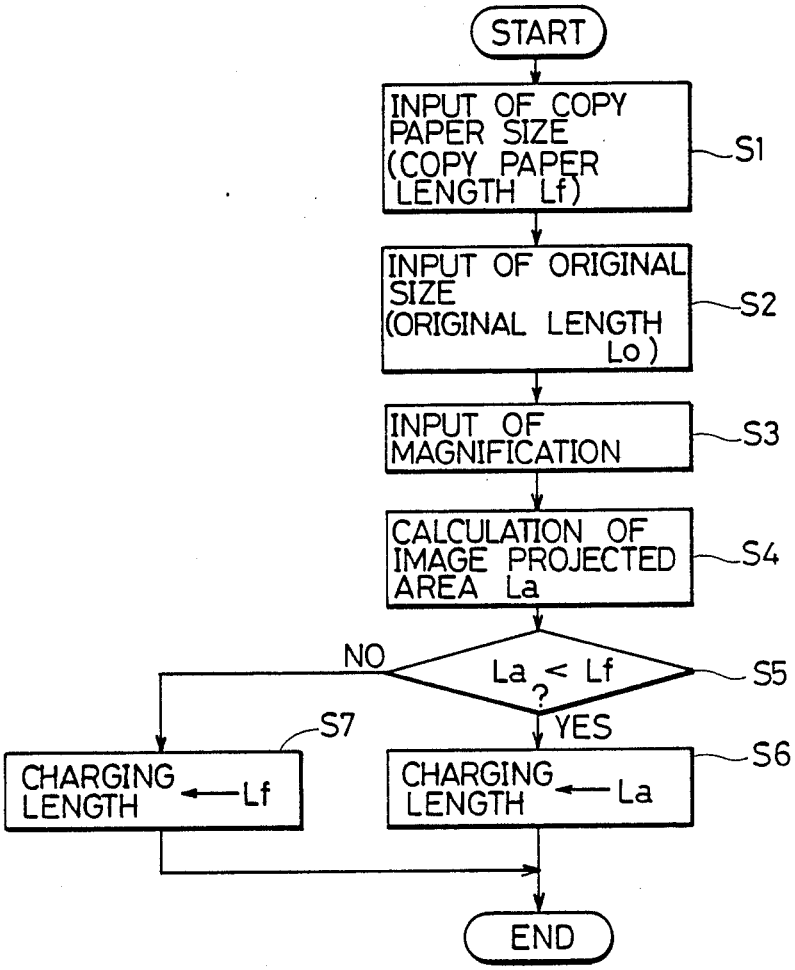
FIGS. 3 and 4 are flow charts showing control procedures.

FIG. 3 shows a preliminary routine for setting the charge area, which is executed prior to control of copying operation to be described later, in which at step S1, the copying paper size (length Lf) is put into the control unit, at steps S2 and S3, the original size (length L) and magnification are input respectively, at step S4, the image projected area length La on the photosensitive drum 9 is calculated. The image projected area length La is obtained by multiplying the original length L by magnification factor. At step S5, it is determined whether the image projected area length La is shorter than the copying paper length Lf, if YES, at step S6, the former is set as the charge length, and if NO, at Step S7, the latter is set as the charge length.

Figure 4:
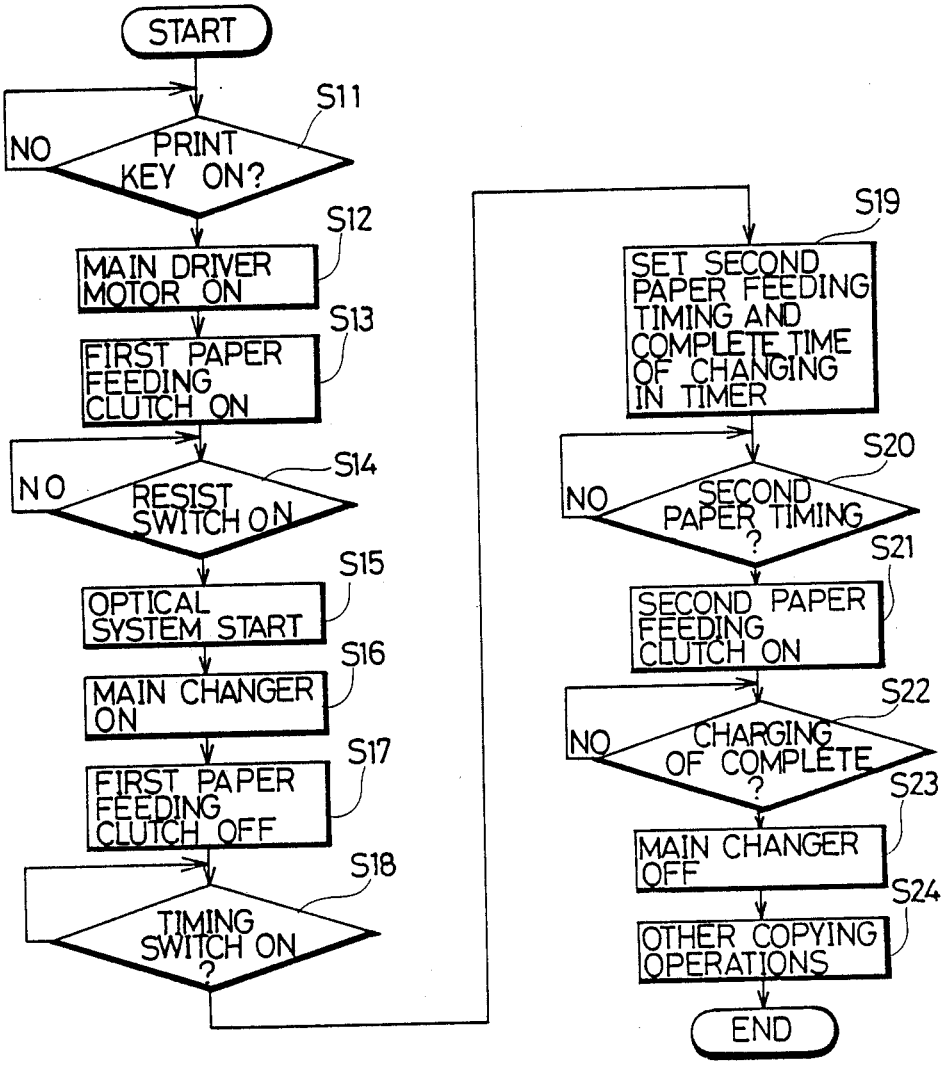

FIG. 4 shows a control routine of the copying operation, in which at step S11, first it is determined whether the print key is set ON, at step S12, then the main driving motor 31 is switched ON, consequently the photosensitive drum 9 comes into rotation. At step S13, the first paper feeding clutch 18 is switched ON Accordingly, the copying paper is fed from the copying paper cassette 15. At step S14, it is determined whether the paper feeding resist switch 22 is set ON, in other words, it is determined whether the copying paper has reached the second paper feeding clutch 19, if YES, at step 15 the optical system driving means 32 is driven to start the optical system, simultaneously, at step S16, the main charger device 10 is set ON and at step S17, the first paper feeding clutch 18 is cut OFF.

Figure 5:
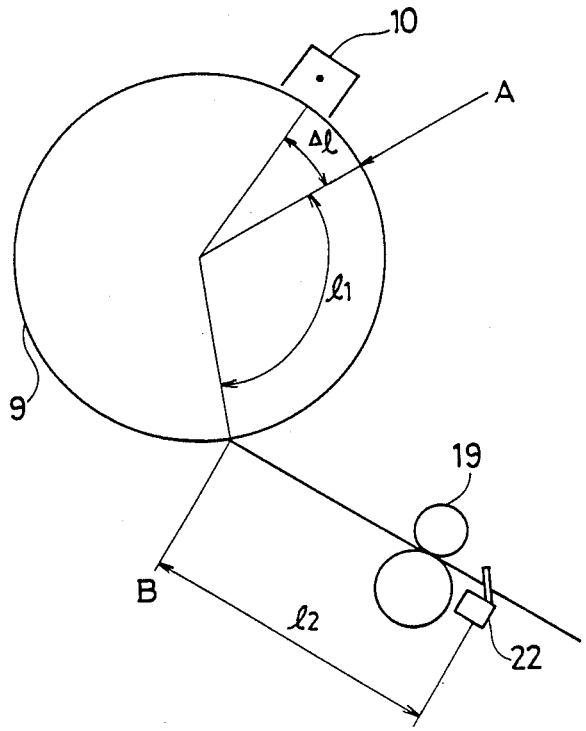
FIG. 5 is an explanatory view showing a relation between charging position, exposing position, transferring position, copying paper feeding position, and a photoreceptor drum.

At the step S18, when it is determined that the optical system timing switch 8 is set ON, on the basis of this point, the second paper feeding timing and time to complete the charging corresponding to the charging setting length are set in a timer at the step S19. In this case, in order to bring the forward end of the image projected area on the photosensitive drum 9 and the forward end of the copying paper sheet into agreement, the second paper feeding start timing is set according to a difference between a circumferential distance $l_1$ of the photosensitive drum 9 which extends from an exposure position A to the transferring position and a distance $l_2$ which extends from the paper feeding resist switch 22 to a transferring position B as shown in FIG. 5. Moreover, time when charging is to be stopped is set according to the set charging length determined in the routine of FIG. 3 as the following manner so as to bring the rear end of the charge area and the rear end of the image projected area or the copying paper into agreement.

That is, when the time from ON of the timing switch 8 to the completion of charging, original length, copying paper length, magnification, length from the main charger means 10 to the exposure position and rotating speed of the photosensitive drum 9 are respectively represented as t, L, Lf, Z(%), Δl (refer to FIG. 5) and V, and in the case that image projected area length La is selected as the set charging (step S6 of FIG. 3), the time t is determined by the following equation.

$$t=\{(L-\Delta l)/V\}X(Z/100),$$

and in the case that the copying paper length Lf is selected (step S7 of FIG. 3), the time t is $$t=(Lf-\Delta l)/V.$$

At steps S20 and S21, the second paper feeding clutch 19 is set ON when the timer reaches the second paper feeding time set as aforementioned, then the copying paper is fed to the transferring position. At steps S22 and S23, the main charger means 10 is switched OFF when the set charging time completes. At step S24, other copying operations are performed and the copying process ends. According to the control described above, with rotation of the photosensitive drum 9, the charge area having a length corresponding to the charging time is formed on the photosensitive drum 9 by the main charger 10. When the charged area passes the exposure position, the reflected image of the original is projected to the drum and the image projected portion is discharged to form an electrostatic latent image consisting of a residual charge. Toner is attracted to the electrostatic latent image to form a toner image while passing the developing means 11, which is in turn transferred onto the copying paper fed at the timing corresponding thereto, when arriving at the transferring position. By the processings at the steps S1–S7 and control the charging time at the steps S19, S22 and S23, the charged area is regulated to correspond to a shorter one between lengths Lf and La of the copying paper and light image irradiating area. When the two lengths are equal, the charge area is made to correspond to the length.

That is, when the copying paper length Lf is shorter than the image projected area length La, the photosensitive drum 9 is charged as far as the position corresponding to the rear end of the copying paper sheet, and the area which is beyond the rear end and impossible to be transferred is not charged, therefore a toner is not wastefully attracted. When the image projected area length La is shorter than the copying paper length Lf, the photosensitive drum 9 is charged as far as the position corresponding to the rear end of image projected area, the area which is beyond the rear end of image projected area and unnecessary to be transferred is not charged. Even when there is an area unnecessary to be transferred in the area corresponding to the copying paper sheet, in other words, beyond the rear end of the image projected area, the toner is prevented from being attracted to the rear end portion of the copying paper.

Although in the embodiment described above, only device for controlling the longitudinal direction (circumference direction of the photosensitive drum 9) of the charge area is described, it is preferable to control the width of charge area so as to correspond to smaller one between the width of copying paper sheet and that of image projected area by additionally providing means for changing the width of charge area. Various means for changing the width of charge area may be employed in the present invention. The change of width of charge area can be accomplished, for example, by providing a plurality of blanking lamps 35 (indicated by two-dot chain lines in FIG. 1) for deleting an unnecessary area from the charged photosensitive drum 9 by irradiating light to the unnecessary area at appropriate positions between the main charger 10 and developing means 11, and controlling the number of switched-on lamps. It is also possible to change the charged width by providing a shielding member for shielding the charge movably between a charging wire of the main charger 10 and the photosensitive drum 9 and moving the shielding member.

Furthermore, the forward end of charge area, that is, the charge starting time may be controlled so as to correspond to the forward end of the image projected area or copying paper.

The present invention may be also applied in a copying machine using a belt photoreceptor or the like in place of the photosensitive drum 9.

We claim:

1. A device for controlling the charge area of a photoreceptor utilized in an image forming apparatus of the type in which an electrostatic latent image is formed on a photoreceptor charged by a main charger by projecting a light image of an original followed by developing the latent image by a developing means and transferring the developed image by transferring means to copying paper, comprising detecting means for detecting the length of a sheet of copying paper, operable means for calculating the length of an image projected area to be projected on the photoreceptor, selecting means for selecting the shorter one between the detected length of the copying paper sheet and the calculated length of the image projected area to be projected on the photoreceptor by comparing said two lengths with each other, and control means for controlling the charging time of the main charger so as to charge the photoreceptor over a charge area corresponding to the length selected by the selecting means.

2. A device according to claim 1, wherein said control means comprises alignment means to align the rear end of said charge area with the rear end of the image projected area.

3. A device according to claim 1, wherein said control means comprises alignment mean to align the rear end of said charge area with the rear end of the copying paper.

4. A device according to claim 1, wherein said detecting means for detecting the length of copying paper comprises a cassette size detecting switch.

5. A device according to claim 1, wherein said detecting means for detecting the length of the copying paper sheet comprises a copying paper size selection key.

6. A device according to claim 1, wherein said operable means comprises original-size input means for inputting the size of the original to be copied and magnification-input means for inputting the degree of magnification of the copy to be made relative to the original, said operable means utilizing inputs from said original-size input means and said magnification-input means for calculating the length of said image projected area.

7. A device according to claim 1, wherein said control means comprises alignment means to align the forward end of said charge area with the forward end of the image projected area.

8. A device according to claim 1, wherein said control means comprises alignment means to align the forward end of said charge area with the forward end of the copying paper.

9. A device according to claim 1 further comprising width control means for controlling the width of the charge area on the photoreceptor.

10. A device according to claim 9, wherein said width control means comprises copy paper width detecting means for detecting the width of the copying paper, width calculating means for calculating the width of the image projected area to be projected on said photoreceptor, and width selection means for selecting the shorter one between the detected width of the copying paper and the calculated width of the imaged projected area, said width control means controlling the width of the charge area to correspond to said selected width.

11. A device for controlling the charge area of a photoreceptor utilized in an image forming apparatus of the type in which an electrostatic latent image is formed on a photoreceptor charged by a main charger by projecting a light image of an original followed by a developing the latent image by a developing means and transferring the developed image by transferring means to copying paper, comprising detecting means for detecting the length of a sheet of copying paper, operable means for calculating the length of an image projected area to be projected on the photoreceptor, selecting means for selecting the shorter one between the detected length of the copying paper sheet and the calculated length of the image projected area to be projected on the photoreceptor by comparing said two lengths with each other, and control means for controlling the main charger so as to charge the photoreceptor over a charge area corresponding to the length selected by the selecting means.

12. A device for controlling the charge area of a photoreceptor utilized in an image forming apparatus of the type in which an electrostatic latent image is formed on a photoreceptor charged by a main charger by projecting a light image of an original followed by developing the latent image by a developing means and transferring the developed image by transferring means to copying paper, comprising detecting means for detecting a dimension of a sheet of copying paper, operable means for calculating a dimension of an image projected area to be projected on the photoreceptor, selecting means for selecting the shorter one between the detected dimension of the copying paper sheet and the calculated dimension of the image projected area to be projected on the photoreceptor by comparing said two dimensions with each other, and control means for controlling the main charger so as to charge the photoreceptor over a charge area corresponding to the dimension selected by the selecting means.

13. A device for controlling the charge area of a photoreceptor utilized in an image forming apparatus of the type in which an electrostatic latent image is formed on a photoreceptor charged by a main charger by projecting a light image of an original followed by developing the latent image by a developing means and transferring the developed image by transferring means to copying paper, comprising detecting means for detecting the length of a sheet of copying paper, operable means comprising original-size input means for inputting the size of the original to be copied and magnification-input means for inputting the degree of magnification of the copy to be made relative to the original, said operable means utilizing inputs from said original-size input means and said magnification-input means for calculating the length of an image projected area to be projected on the photoreceptor, selecting means for selecting the shorter one between the detected length of the copying paper sheet and the calculated length of the image projected area to be projected on the photoreceptor by comparing said two lengths with each other, and control means for controlling the charging time of the main charger so as to charge the photoreceptor over a charge area corresponding to the length selected by the selecting means, said control means comprising alignment means to align the rear end of said charge area with the rear end of the image projected area and with the rear end of the copying paper.

* * * * *